United States Patent [19]

Del Bon

[11] 4,128,349

[45] Dec. 5, 1978

[54] FOUNTAIN BRUSH

[76] Inventor: Luigi Del Bon, 141, Feldstrasse, Aarburg, Switzerland, CH-4663

[21] Appl. No.: 764,014

[22] Filed: Jan. 31, 1977

Related U.S. Application Data

[63] Continuation-in-part of Ser. No. 717,359, Aug. 24, 1976, Pat. No. 4,088,412.

[30] Foreign Application Priority Data

Dec. 4, 1976 [CH] Switzerland ..... 15249/76
Jul. 19, 1976 [CH] Switzerland ..... 9311/76

[51] Int. Cl.[2] ..... A46B 11/08

[52] U.S. Cl. ..... 401/151; 401/153; 401/176; 401/286

[58] Field of Search ..... 401/151, 153, 156, 176, 401/171, 177, 181, 182, 270, 278, 286

[56] References Cited

U.S. PATENT DOCUMENTS

| | | | |
|---|---|---|---|
| 841,946 | 1/1907 | Downing | 401/278 |
| 856,082 | 6/1907 | Moore | 401/153 |
| 1,787,896 | 1/1931 | Chamberlin | 401/153 |
| 1,918,069 | 7/1933 | Wallace | 401/182 |
| 2,997,078 | 8/1961 | Gainer | 401/175 |
| 3,827,813 | 8/1974 | Stryczek | 401/151 |

FOREIGN PATENT DOCUMENTS

| | | | |
|---|---|---|---|
| 24019 of | 1911 | United Kingdom | 401/278 |

*Primary Examiner*—Stephen C. Pellegrino
*Attorney, Agent, or Firm*—Gilbert L. Wells; Heinrich W. Herzfeld

[57] ABSTRACT

A fountain brush has a bristle carrier and a set of bristles on one end thereof, a handle attached to the other end of the bristle carrier and a reservoir a channel extends axially through the bristle carrier from the reservoir into the bristle-bearing end of the carrier; the channel has at least one radial outlet orifice in the sidewall of the carrier. A slide valve member is guided sealingly in the interior of the channel. A closure member is adapted for hermetically closing the reservoir. A connecting rod extends substantially axially through the interior of the reservoir and connects the actuating device and the slide valve member to one another. The closing member is at such distance from the slide valve member that, in a filling position in which medium can be filled into said reservoir, the closing member leaves the open end of the handle free while the slide valve member seals off the reservoir; an elastically deformable bellows is connected hermetically sealingly with the closing member, and with the inner wall of the handle, in actuated as well as in unactuated position of the actuating device, thereby closing the reservoir; the slide valve member obturates the orifice when in the said unactuated position and, upon actuation by pressure on the closing member, is moved into the blind end of the channel past the orifice clearing the latter.

22 Claims, 14 Drawing Figures

FIG.11
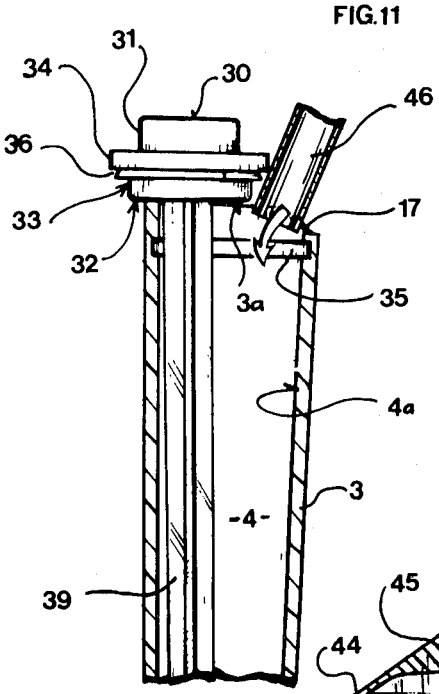
FIG.12
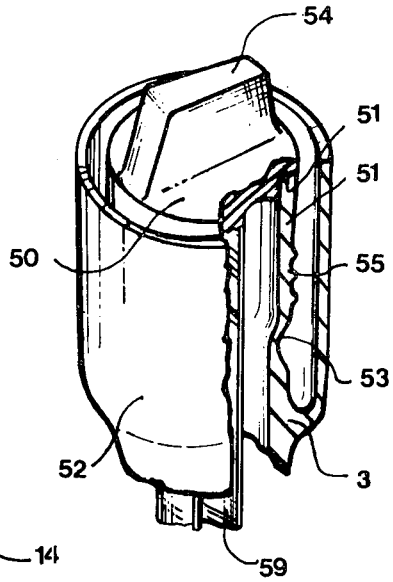
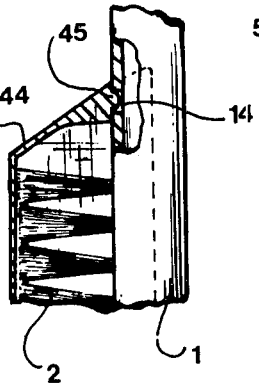
FIG.14
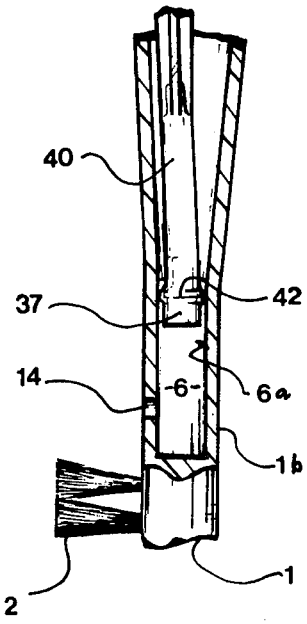
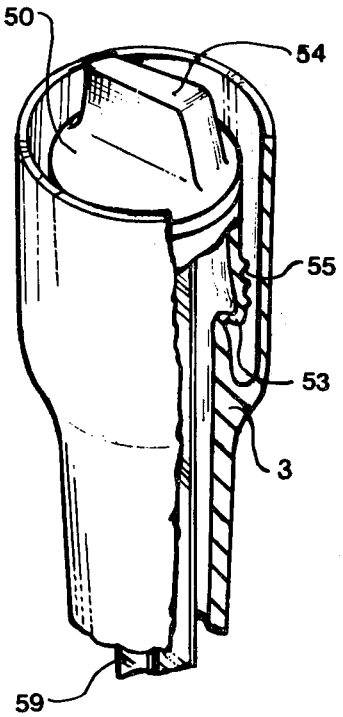
FIG.13

FOUNTAIN BRUSH

RELATIONSHIP TO CO-PENDING APPLICATION

This patent application is a continuation-in-part of my co-pending patent application Ser. No. 717,359 filed on Aug. 24, 1976, now U.S. Pat. No. 4,088,412.

The invention relates to a fountain brush with a bristle carrier and a set of bristles on one end of the latter, with a handle which adjoins the other end of the bristle carrier, is constructed integrally with the bristle carrier, contains a reservoir for a liquid or pasty medium and has an open end remote from the bristles, with a channel which leads axially through the handle from the reservoir, and has at least one radial outlet orifice in the side wall of the bristle carrier and has a blind end in the tip of the bristle carrier at a distance from this outlet orifice, with a slider sealingly guided in the interior of the channel, with an actuating device mounted at the end of the handle remote from the bristles, with a closure member which seals the reservoir hermetically after the medium has been filled thereinto and with a connecting rod which extends substantially axially through the reservoir and joins the slider to the actuating device in such a way that, in the rest position of the actuating device, it closes the radical outlet orifice and leaves the latter open when the said device is actuated.

A fountain brush of this type has already been disclosed in British Patent Specification No. 1,244,915 for use as a toothbrush.

This toothbrush, however, is not suitable for being manufactured as a mass-produced article by modern fabrication methods, in particular manufacture by the injection-molding process, since it comprises too many individual parts and its assembly, filling with tooth-cleaning agent and its sealing require expensive machines and its use also is too complicated. Above all, filling with the said medium must be carried out, after all the components of the actuating device have been completely assembled and the latter has assumed its closing position, through this device and through a special filling orifice which must be screwed shut in a special working step when filling has been completed. It is necessary to actuate the closure device both for opening and for closing the outlet orifice, by turning the lid on the reservoir. Furthermore, the insertion of the connecting rod requires an eccentric assembly of the parts by means of a complicated assembling machine.

British Patent Specification No. 913,371 describes a toothbrush consisting of a handle which has an inner cavity for receiving a creamy medium and possesses, at the end remote from the bristles, a bellows communicating with the cavity, the medium being pressed out through a lateral orifice present in the bristle part when the bellows is actuated by pressure. In this design, the bellows has an air outlet valve which communicates with the cavity via a one-way valve and which is in turn connected to an air inlet valve via a further one-way valve.

Toothbrushes of this type have the disadvantage of demanding expensive working methods if only due to the manufacture of the bellows. Moreover, the valves are very prone to blockage, for example by grains of foreign bodies, such as cannot be kept away when the toothbrush is left in luggage or is carried about in clothing so that the mechanism becomes incapable of functioning.

It is now an object of the present invention to provide an improved fountain brush of the initially described type, which can be manufactured extremely simply by mass production methods, whilst at the same time the filling process can be carried out substantially more easily than for the fountain toothbrush of the prior art. Preferably, the fountain brush according to the invention should be used as a throw-away brush.

It is a further object of the invention to provide a fountain brush of the initially described type, by means of which metered amounts of the medium can be applied to the bristles.

It is yet a further object of the invention to provide a fountain brush of the initially described type which, for being actuated, requires only one movement to open the outlet orifice and in which means are provided to close the outlet orifice automatically.

These and further objects, which will emerge from the text of the description which follows, are achieved by a fountain brush of the initially described type, wherein the closure member of the actuating device and the slider are, via the connecting rod, rigidly joined to one another at such a distance that, in a filling position for the medium, the closure member releases the end of the handle remote from the bristles and the slider is located in the channel in a position further away from the blind end of the latter than the outlet orifice, and wherein the closure member possesses an elastically deformable bellows which, in the rest position of the actuating device and in an actuating position, is joined to the closure member on the one hand and to the inner wall of the handle on the other hand, so as to form a hermetic seal, and closes off the reservoir, and, in the said rest position, the slider in the channel closes the outlet orifice and, when actuated by exerting pressure on the closure member, is pushed past the outlet orifice into the blind end of the channel and leaves the outlet orifice open.

This bellows can be designed as a return spring element and the sealing connection between the closure member on the one hand and the inner wall of the handle on the other hand is formed only after the medium has been filled into the reservoir. This leaktight joint can be formed by ultrasonic welding, gluing or a frictional connection.

Moreover, it is preferable that the bristle carrier, the channel therein, the handle containing the reservoir, the bellows, the closure member, the slider and the connecting rod are arranged on a common longitudinal axis which is central for each of the components mentioned, the closure member, the connecting rod and the slider being constructed as one integral piece. The bellows can also be constructed integrally with the wall of the reservoir.

Preferably, the bellows can be constructed integrally with the closure member and have an annular fold which, by its apex, points into the reservoir, is upset outwards and the outer wall of which can, by its free circumferential rim, be sealingly fixed to the inner wall of the handle. In the zone from the apex of the annular fold towards the open end of the handle, the inner wall of this handle can possess an annular groove into which the outer wall of the annular fold is sealingly inserted by its free circumferential rim when the reservoir has been filled with the medium.

While the channel, on the one hand, in the region of its end portion which comprises the outlet orifice, can be devised as a cylinder, the slider on the other hand can be a piston of circular cross section, and sealing means can be provided between the cylindrical wall of the channel and the cylindrical surface of the piston.

The connecting rod can have a diameter which is such that between its outer wall and the inner wall of the channel there remains an annular gap of such diameter that it exerts an capillary action on the medium, slowing down its discharge.

Preferably, the connecting rod can also carry, in its region adjoining the piston, a disc firmly joined to it, the diameter of the disc being smaller than the open width of the region of the inner wall of the reservoir which is opposite the disc when the slider is in the closed position. At the same time, the reservoir can taper conically towards the channel, at least from the region of its inner wall which is opposite the disc, in such a way that on exerting pressure on the closure member to cause opening, the release of the outlet orifice is followed by the piston, the disc is sealingly forced against the conical region of the inner wall of the reservoir.

The wall of the handle which contains the reservoir can preferably be of rigid construction starting from its end close to the bristles towards its bristle-free end, which carries the actuating device, and up to at least the zone at which it adjoins the bellows. A sleeve which has a rigid wall and is open at the end of the handle remote from the bristles can be provided around the bellows.

Moreover, at least one lateral cut-out can be provided in the sleeve, through which the bellows can be reached by a fingertip. Preferably, the side wall of the bellows can be provided with a helicoidal fold.

The closure member can have the form of a cap and be provided with an internal thread which can be screwed onto the fold of the bellows and which, when completely screwed onto the bellows, prevents compression of the latter and only permits compression of the bellows, and release of the outlet orifice by the piston, when the cap is at least partially unscrewed from the bellows.

Furthermore, the end portion of the channel in the bristle carrier can preferably extend sufficiently far beyond the terminal actuating position of the piston so that an air cushion is formed between the latter and the end wall of the channel when the slider is pushed in so as to release the outlet orifice.

Preferably, the interior of the bellows is also a part of the reservoir in the handle.

Finally, the fountain brush according to the invention can preferably comprise a protective cap for the bristles, which cap can be pushed over the bristle carrier, transversely to the said longitudinal axis, and carries a nose which closes the outlet orifice when the protective cap is fitted.

BRIEF DESCRIPTION OF THE DRAWINGS

Further details of the fountain brush according to the invention are described in relation to the accompanying drawings. In these:

FIG. 11 shows the same embodiment as in FIGS. 7 and 8, but with the closure member, the bellows and the connecting rod in the filling position;

FIG. 12 shows a further embodiment of the end, of the fountain brush remote from the bristles in a perspective and partially cut view and in the rest position;

FIG. 13 shows a view similar to that of FIG. 12, but in the actuated position; and FIG. 14 shows a partial sectional view of a further embodiment of the protective cap.

DETAILED DESCRIPTION OF PREFERRED EMBODIMENTS OF THE INVENTION

Figure 1:
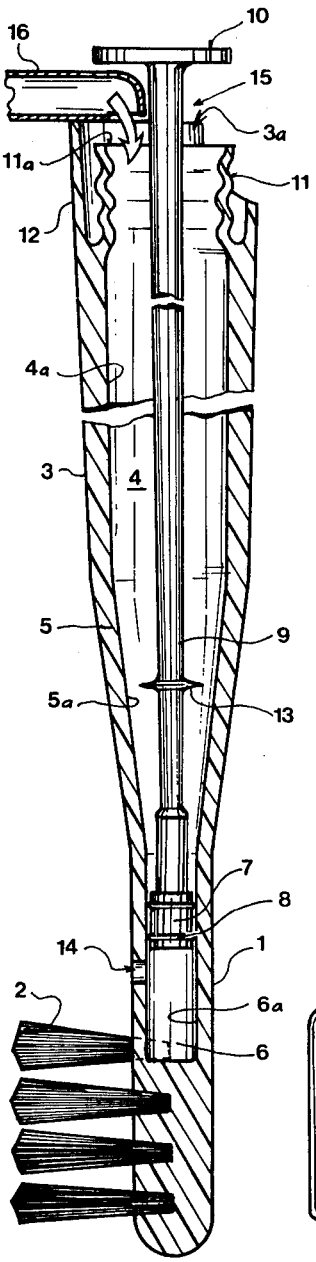
FIG. 1 shows, in interrupted longitudinal sectional view, a preferred embodiment of the fountain brush according to the invention, in which the parts are in the position necessary for filling a medium into the reservoir.
Figure 2:
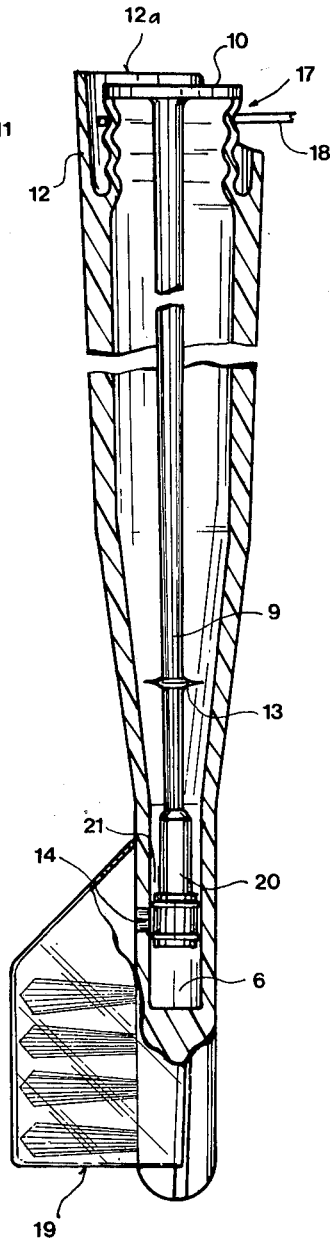
FIG. 2 shows the same longitudinal sectional view, but with the fountain brush in the closed position, after filling has been completed.
Figure 3:
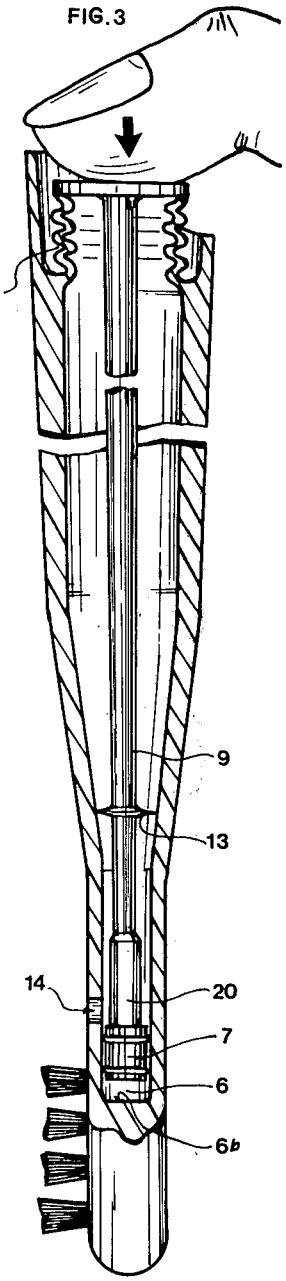
FIG. 3 shows the same longitudinal section, but with the fountain brush in the opened position for dispensing a medium onto the bristles.

In the embodiment shown in FIGS. 1 to 3, the fountain brush has a bristle carrier 1 provided, in the usual manner, with a set of bristles 2. The bristles can point in one direction, for example when the dispenser brush is to be used as a toothbrush or as an applicator brush for shoe polish, but they can also project from the bristle carrier radially to the longitudinal axis of the brush, in several or all directions. Finally, they can also be attached in the manner of a paint brush, at an angle to the bristle carrier, and project beyond the front end (that is to say the lower end, in the drawing) of the bristle carrier.

The bristle carrier 1 is joined at the back (that is to say upwardly, in the drawing) to the handle 3, which is preferably constructed integrally with the bristle carrier 1.

The hollow interior of the handle 3 serves as a reservoir 4, which in the embodiment shown is of cylindrical configuration in its middle and rear region, whilst in the direction toward the bristle carrier 1 it tapers conically in a transition region 5 and finally terminates in a channel 6, of constant corss-section, in the bristle carrier 1.

The slider, built as a cylindrical piston 7, travels in the channel 6 and produces a hermetic seal against the channel wall by virtue of its sealing beads 8, which are preferably injection-molded onto the piston. From the piston 7, the connecting rod 9 extends backwards out of the open end 3*a* of the handle 3 and carries, at its outer end, the press-member which is constructed as a circular disc 10.

The periphery of the press-disc 10 is so chosen that the same can serve to seal the open end 11*a* of compressible bellows 11 possessing several folds, the bellows being attached to the inner wall 4*a* of the handle surrounding the reservoir 4, and preferably being integral with the said handle; the bellows are surrounded by a rigid sleeve 12 which in turn forms the end portion, remote from the bristles, of the handle 3. The outer rim of the sleeve 12, which surrounds the open end 3*a* of the handle, projects sufficiently far beyond the upper rim 11*a* of the bellows 11 to protect the latter against unintentional compression. A disc 13 is mounted on the connecting rod 9, between the piston 7 and the press-disc 10, the diameter of the disc being such that in a given advanced position of the piston 7 in the channel 6, the rim of the disc 13 can rest against the inner wall 5*a* of the conical region 5 of the reservoir 4 (FIG. 3).

Filling and sealing of the fountain brush

On filling a medium into the reservoir 4, the actuating unit, which comprises the piston 7, connecting rod 9 and press-disc 10, and which is preferably made of one piece, is first moved some distance outwards in the channel 6, so that on the one hand an outlet orifice 14, leading from the interior of the channel through the wall of the bristle carrier 1, is shut off leaktight from the reservoir 4 by the piston 7, whilst on the other hand a sufficiently large gap 15 remains free between the disc 10 which represents the press-member and the upper rim 11*a* of the bellows 11, so that an injection nozzle 16 for liquid medium, resting on the upper rim of the sleeve 12, can be introduced into the gap 15.

The entire cavity of the reservoir can now be filled, through the nozzle 16, up to the upper rim 11*a* of the bellows 11.

In the case of automatic filling, the fountain brush is now moved away from the fixed nozzle 16 and thereafter the press-disc 10 is pressed to bring it to the non-actuated closed position shown in FIG. 2, in which it rests on the upper rim 11*a* of the bellows 11, whilst at the same time, if the length of the connecting rod 9 is correctly chosen, the piston 7 continues to seal the interior of the reservoir 4 hermetically from the outlet orifice 14. On pressing-in the actuating unit, the level of the medium in the reservoir 4 falls slightly so that a small air-filled space, extending up to the underside of the pressure member 10, remains in the interior of the bellows, above the level of the medium. This space is desirable since, in the position shown in FIG. 2, it is now possible to weld or glue the periphery of the disc 10 to the peripheral rim 11*a* of the bellows 11 without adversely affecting the medium.

In the sleeve 12 there is preferably, on the side of the actuating finger, a cut-out 17, through which a tong-like or fork-like instrument 18 can be introduced for engaging the uppermost fold of the bellows 11; this instrument firmly holds the bellows in the normal, relaxed position during production of a tight bond between the upper rim 11*a* of the bellows and the press-disc 10, and thus secures the bellows against unintentional compression. After closing the filled reservoir 4, as described, the instrument 18 is again removed and the fountain brush is now ready to use.

Use of the fountain brush

In order to use the fountain brush, which is in the non-actuated position shown in FIG. 2, for example to use it as a toothbrush or for applying shoe polish, a slight pressure is exerted on the press-disc 10 by means of one finger of the hand which holds the brush, and thereby, as shown in FIG. 3, the bellows 11 are compressed and the connecting rod 9, carrying the disc 13, is moved downwards, and the piston 7 is pushed beyond the outlet orifice 14 into the channel 6. This produces a free communication, permitting unhindered flow, between the interior of the reservoir 4 and the outlet orifice 14, with the disc 13 assisting in forcing the liquid into the conical region 5 of the reservoir 4, until its peripheral rim encounters the inner wall of the region 5, thereby restricting the amount of medium dispensed to a determined dose.

In the case of media of particularly low viscosity it can be desirable to exert a capillary action, preferably a braking action, at the inner wall of the channel 6 on the medium which flows to the outlet orifice 14. For this purpose the connecting rod 9 possesses, at its end connected to the piston 7, a cylindrical thickened portion 20 of such diameter as to leave, between the thickened portion and the inner wall 6*a* of the channel 6, a small annular gap 21, the cross-section of which exerts a greater or lesser capillary action on the medium, in accordance with the viscosity of the latter.

In the actuated position shown in FIG. 3, the piston 7 has left an air cushion under pressure in the end portion 6*b* of the channel 6; after lifting the finger off the press-disc 10, this air cushion can assist the return of the bellows 11, which now act as a return spring, to the relaxed position shown in FIG. 2.

Furthermore, when the piston 7 and bellows 11 are being returned to their starting position as shown in FIG. 2, air is briefly drawn in through the outlet orifice 14, to balance the pressure in the reservoir 4, until the piston 7 closes the outlet orifice 14.

Figure 4:
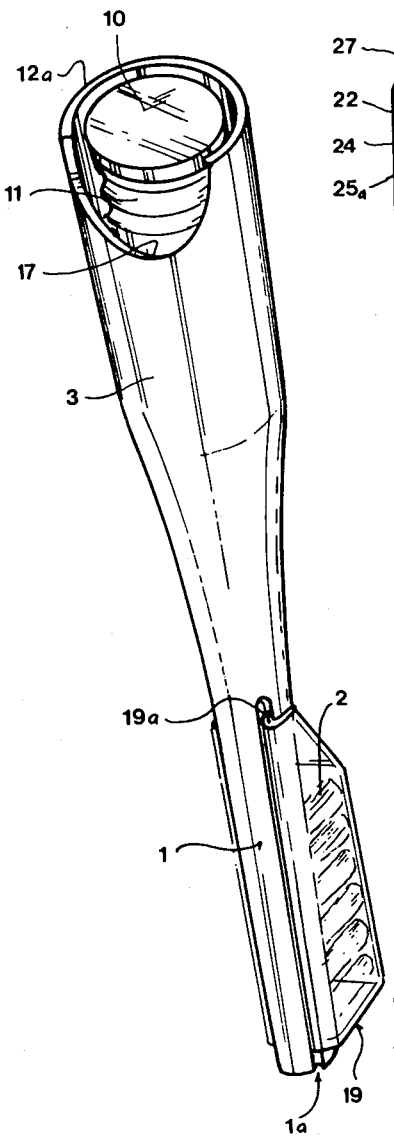
FIG. 4 shows a perspective view of the integral structure of the bristle carrier and handle, before introducing the actuating unit, but with the protective cap fitted onto the bristles.

In the perspective view, shown in FIG. 4, of the body of the fountain brush, consisting integrally of the bristle carrier 1 and the handle 3, in the embodiments of FIGS. 1 to 3, the actuating unit comprising the piston 7, connecting rod 9 and press-disc 10 has not yet been inserted. On the other hand, the set of bristles 2 is covered by a protective cap 19, which carries, at its lower open longitudinal edges, internal beads 19*a* which engage in corresponding longitudinal grooves 1*a* in the side wall of the bristle carrier 1, on either side of the set of bristles 2.

Figure 5:
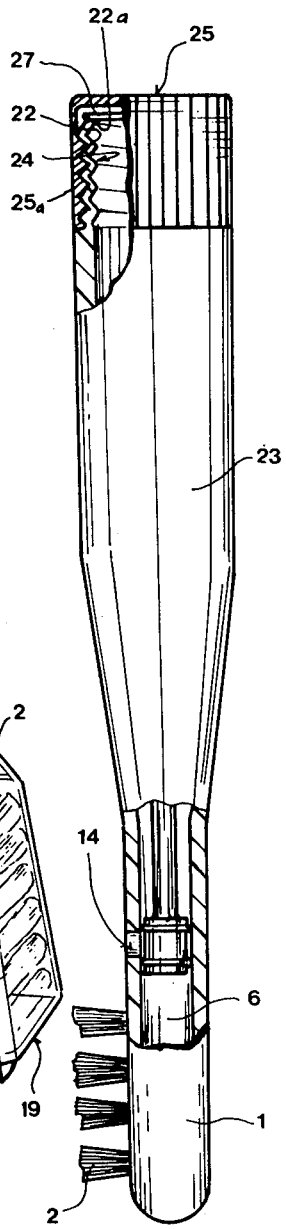
FIG. 5 shows a longitudinal sectional view of a further embodiment of the fountain brush in the closed position, secured against actuation.
Figure 6:
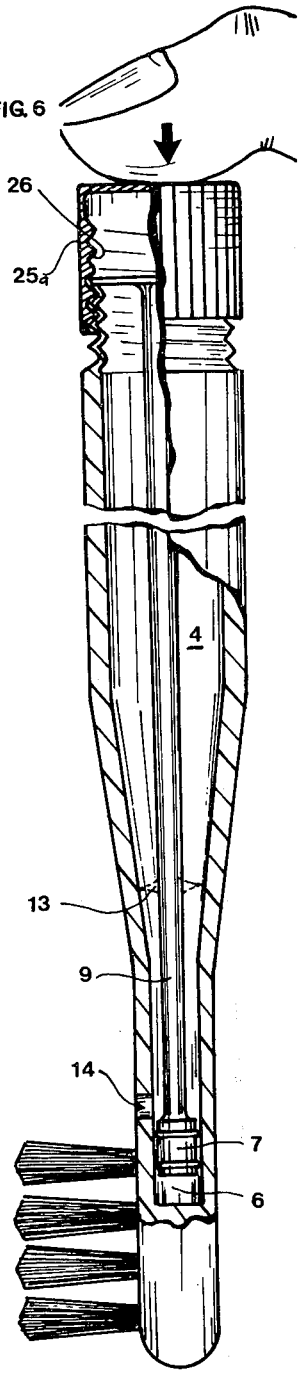
FIG. 6 shows a longitudinal sectional view of the same embodiment, in the actuated position.

In the embodiment shown in FIGS. 5 and 6, the bellows 22 are not surrounded by a rigid sleeve but form the rear (upper) end of the handle 23 and possess a helicoidal fold in the bellows wall. The bristle carrier 1, the channel 6 in the latter, the outlet orifice 14 and the set of bristles 2 are virtually identical with those of the first embodiment.

In order to prevent unintentional actuation of the second embodiment, shown in the rest position in FIG. 5, a securing and actuating cap 25 is crewed onto the outer thread formed by the fold 24 in the bellows 22, by means of the inner thread 26 which is provided on the side wall 25*a* of the cap 25 and fits the outer thread of the bellows, untill all the turns of the fold 24 rest against corresponding turns of the inner thread 26. This prevents compression of the fold 24 of the bellows 22 when pressure is exerted axially on the cap 25.

If the cap 25 is unscrewed so that a part of the helicoidal fold 24 is exposed below the cap 25 and out of contact with the internal thread 26, this exposed region of the bellows 22 can be compressed if pressure is exerted on the upper face of the cap 25, and as a result the sealing disc 27, which, after the filling of the reservoir 4, has, also in the instant embodiment, been joined firmly and sealingly to the upper rim 22*a* of the bellows 22, and the connecting rod 9 bearing disc 27, and the piston 7, are moved downwards until the outlet orifice 14 is freed (FIG. 6).

The more the cap 25 is unscrewed from the fold 24 of the bellows 22, the more the bellows 22 can be compressed and the more the pressure on the surface of the medium in the interior of the reservoir 4 can be increased.

Figure 7:
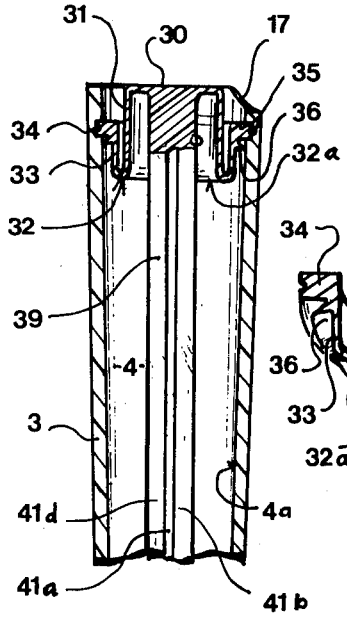
FIG. 7 shows a longitudinal sectional view of another preferred embodiment of the fountain brush according to the invention in the rest position, the outlet orifice being closed.
Figure 8:
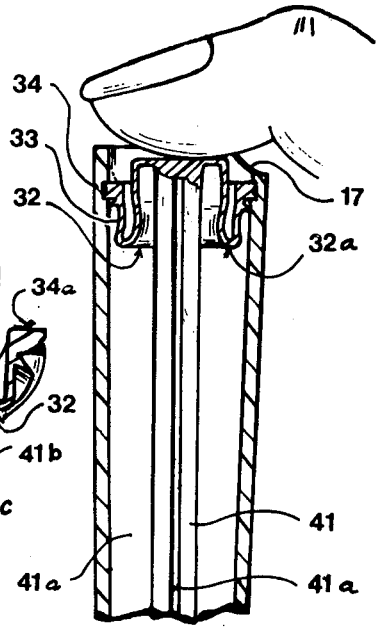
FIG. 8 shows the same longitudinal section as FIG. 7, the actuated position having been effected by finger pressure so that the outlet orifice is released.

In the particularly preferred embodiment of the fountain brush according to the invention, represented in FIGS. 7 and 8, a hat-shaped bellows 31 surrounds the end region, remote from the bristles, of the connecting rod 39 and is integrally joined to the circumferential rim of the closure member 30 serving as the press-member so that this closure member forms the top of the hat. Furthermore, the bellows 31 are crimped, below the closure member 30, to form an annular fold 32 with an annular apex 32*a* which points inwards, that is to say towards the bristles 2. The circumferential bead 34 of that part of the wall of the bellows which forms a crimp 33 and points outwards, is firmly and sealingly inserted, a little above the annular apex 32*a* of the bellows 31, into an annular groove 35 in the inner wall 4*a* of the handle 3, so that the bellows 31 does not leave the annular groove 35 when the fountain brush is actuated.

A little below its circumferential bead 34, the crimp 33 carries, on its outer wall, an annular sealing lip 36 which is pressed against the inner wall 4*a*, forming a hermetic seal, when the circumferential bead 34 snaps into the annular groove 35.

Figure 10:
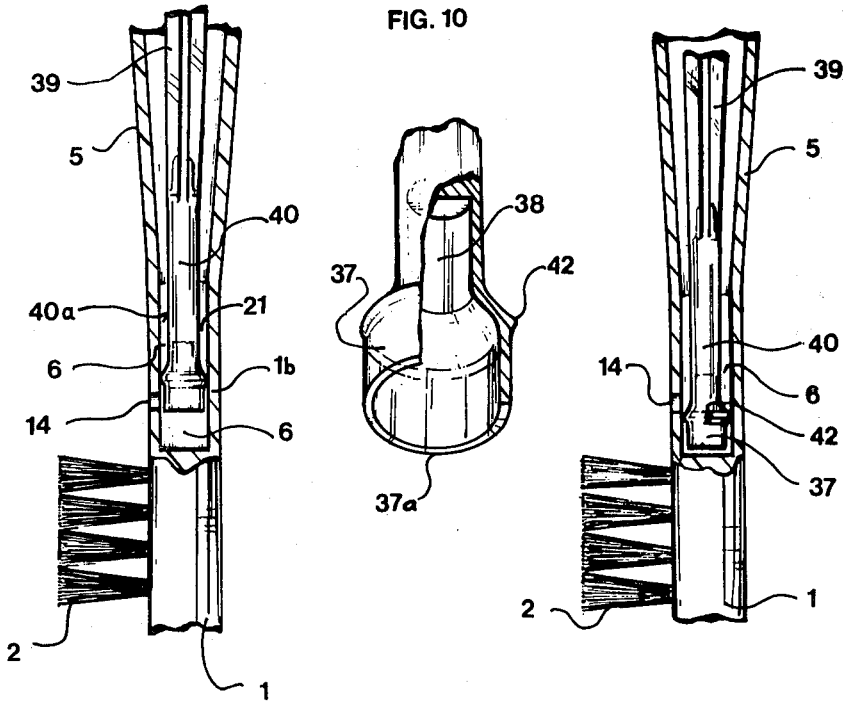
FIG. 10 shows the piston and the adjoining end of the connecting rod in a perspective and partially cut view.

As in the preceding embodiments, the connecting rod 39 here also carries, at its end near the bristles, a piston 37 (FIG. 10) possessing a cavity 38 which extends into the connecting rod and ends at the frontal face 37*a* of the piston. In its region 40 which is near the bristles and carries the piston 37, the connecting rod 39 is elastically flexible and is surrounded, in this entire region, by the narrow annular gap 21 formed between the inner wall 6*a* of the channel 6 and the outer wall 40*a* of the connecting rod region 40.

In the region 5 of the reservoir 4, which region conically widens towards the end remote from the bristles, the connecting rod 39 which extends up to the closure member 30 is formed by four axial ribs 41*a*, 41*b*, 41*c* and 41*d* which merge with one another along the central rod axis and start at the upper end of the elastically flexible region 40.

Figure 9:
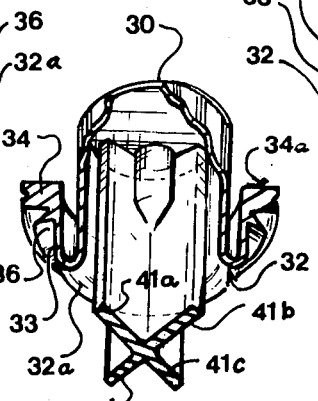
FIG. 9 shows a perspective view, obliquely from below, of the closure member, the bellows and the upper part of the connecting rod, the closure member and the bellows being cut axially.

FIG. 9 shows the end, remote from the bristles, of the connecting rod 39 (viewed perspectively from below), the closure member 30 and the bellows 31 (the latter being axially cut open), in a position rotated about the central longitudinal axis by 45° relative to the plane of FIG. 7.

At its end remote from the bristles, the piston 37 carries an annular bead 42 through which it is always in hermetic contact with the channel wall 6*a*, in the rest position and also in the filling position and in the actuated position.

In the case where both the bristle carrier 1 with the handle 3 and the actuating unit consisting of the closure member 30 with the bellows 31, connecting rod 39 and piston 37 are manufactured by the injection-molding process from thermoplastics, the piston 37 on the one hand and the bristle carrier neck portion 1*b* which contains the channel 6 and, as the cylinder, cooperates with the piston will always be obtained with larger tolerances than would be necessary, for example, in the case of manufacturing these components from metal and grinding the piston into the cylinder.

The cavity 38 in the piston 37 now permits the piston to be made relatively thin-walled, and this allows good uniform cooling of the plastic after the injection-molding and avoids distortions in the configuration of the piston. The fact that the cavity 38 is open on the frontal face 37*a* makes it possible to remove the core axially after the production by injection-molding.

The thin walls of the piston 37 and the presence of the sealing annular bead 42 also have special advantages in the filling position (FIG. 11) because, in this position, the connecting rod 39 with the piston 37 has been introduced into the bristle carrier neck portion 1*b* only so far that the annular bead 42 is still in hermetically sealing contact with the upper end zone of the channel 6, remote from the bristles, whilst the annular apex 32*a* of the bellows 31 is in a position just above the open end 3*a* of the handle 3. Due to the transversely elastically flexible nature of the region 40, close to the bristles, of the connecting rod 39, the bellows 31 and the closure member 30 can now be laterally displaced by such a distance that the upper end 3*a* of the handle 3 is left open to such an extent that a filling tube 46 of the filling machine can fill the liquid medium into the reservoir 4 unhindered and without losses.

In spite of the deformation of the region 40, close to the bristles, of the connecting rod, the annular bead 42 remains in hermetically sealing contact with the channel wall 6*a*.

Experiments have been carried out with a fountain brush according to the invention, of which the outer part consisting of the bristle carrier 1 and the handle 3 had been manufactured from an acrylonitrile/-butadiene/styrene copolymer with a gross density of 1.06 g/cm$^3$, a modulus of elasticity (bending test) of 2,400 N/mm$^2$ and a Vicat softening point (measured in glycol according to DIN 53,460) of 98° C. (for example Terluran ®877 T from BASF, Ludwigshafen, Germany) and the actuating unit comprising the closure member 30, the bellows 31, the connecting rod 39 and the piston 37 had been manufactured from a high-pressure polyethylene, containing about 1% by weight of oleic acid amide as a plasticiser, with a density of 0.918 g/cm$^3$ and a modulus of elasticity (bending test) of 140 N/mm$^2$ (for example Lupolen ®1810 H from the same company). The fountain brush manufactured in this way was charged, in the filling position according to FIG. 11, with 94% strength ethanol, and the piston 37 perfectly sealed the channel 6.

If, instead of Terluran ®877 T, a styrene/acrylonitrile copolymer, for example Luran ®388 S from the same company, was used, perfect sealing was still achieved with a 40% strength aqueous ethanol.

When the reservoir 4 has been filled with liquid medium, preferably up to the level of the annular apex 32*a* of the bellows 31, the fountain brush is removed from the filling tube 46 and the actuating unit is then moved to its central position at the open end 3*a* of the handle 3, the connecting rod 39 including its region 40 close to the bristles being straightened. By means of axial pressure onto the outer annular face 34*a* of the circumferential bead 34, the actuating unit is now pressed into the interior of the handle 3 until the circumferential bead 34 of the bellows 31 snaps into the annular groove 35 in the reservoir wall 4*a*. The piston 37 is thus pushed further into the channel 6 but, due to the appropriately provided length of the connecting rod 39, it still remains above the outlet orifice 14 (i.e., more remote from the bristles). The fountain brush is then in the rest position shown in FIG. 7.

The protective cap 44 (FIG. 14) fitted over the bristles 2 carries, on its rim resting on the bristle carrier 1, a nose 45 which projects into the outlet orifice 14 and sealingly closes it from the outside.

Instead of letting the protective cap of the above design snap into the longitudinal grooves 1*a* transversely to the longitudinal axis of the bristle carrier 1, it is also possible to use a protective cap of the type shown in FIG. 4, which is open in its chamfered frontal wall 19*b*, facing the bellows, and which can then be pushed, from the free end of the bristle carrier 1, into the longitudinal grooves 1*a* of the latter in an axial direction (FIGS. 2 and 4).

In use, the protective cap 19 or 44 must be taken off.

This embodiment is then actuated by exerting pressure with a finger on the closure member 30 so that the crimp 33 is slightly deformed in the direction toward the bristles 2 and the piston 37 is moved from the closing position (FIG. 7) into the actuated or orifice-opening position (FIG. 8).

When the finger pressure on the closure member 30 ceases, the crimp 33 of the bellows 31 returns again to the initial position due to the elasticity of the bellows material. The crimp 33 here acts as a return spring for the piston 37.

The embodiment shown in FIGS. 12 and 13, of the fountain brush, is similar to that of FIGS. 1 to 3, but the bellows 51 here possess only a single thin-walled folded zone 53.

As in the embodiment of FIGS. 1 to 3, the connecting rod 59 can here also be pressed into the sleeve 52 by exerting an axial pressure on the closure member 50 which has been ultrasonically welded onto the outer rim 51*a* of the bellows 51, so that the piston (not shown here) is displaced from the rest position according to FIG. 12 into the open position according to FIG. 13 in the same way as is the case when the piston 7 is displaced from the rest position according to FIG. 2 into the open position according to FIG. 3. The folded zone 53 here forms the fold shown in FIG. 13.

When only one flat fold is formed instead of the plurality of folds in the bellows 11, axial removal of the core in the manufacture by injection-molding is facilitated. In this way, the bellows 51 also is more easily pressed down than the bellows 11 and returns to its initial position (FIG. 12) more uniformly.

The embodiment according to FIGS. 12 and 13 is not constructed to be actuated by an axial pressure but, on the contrary, its actuation requires even less force, due to the fact that the closure member 50 is not pressed but rotated. For this purpose, the outside of the closure member 50 carries a rotatable handle 54.

For actuation, the rotatable handle 54 is grasped, for example by the thumb and index finger, and rotated; this causes in the folded zone 53, a deformation which shortens the bellows and by means of which the piston 37 is pushed via the connecting rod 59 into the channel 6 up to the blind end 6*b* thereof and the outlet orifice 14 is freed.

If the connecting rod 59, as shown in FIGS. 12 and 13, is provided with ribs similar to those of the embodiment shown in FIGS. 7 to 11, the fountain brush according to FIGS. 12 and 13 can be filled in the same simple manner as the embodiment according to FIGS. 7 to 11 in the filling position shown in FIG. 11; in this case, however, in the same way as in the embodiment according to FIGS. 1 to 3, the bellows 51 is constructed integrally with the wall of the handle 3 on the one hand and the connecting rod 59 is constructed integrally with the closure member 50, on the other hand.

In order to avoid an excessively easy actuation of the embodiment according to FIGS. 12 and 13, the outside of the bellows 51 can carry transverse or helicoidal annular stiffening ribs 55 above the folded zone 53.

The design of the individual components of the fountain brush according to the invention can be modified in many diverse ways. Thus, for example, in the embodiment acccording to FIGS. 7 to 11, the circumferential bead 34 of the bellows 31 can be screwed into the annular groove 35 if the latter runs helicoidally from the open end 3*a* of the handle 3 up to its position shown in FIGS. 7, 8 and 11 and if the face of the rim of the circumferential bead 34 has a corresponding shape.

Preferably, the outlet orifice 14 is offset by such a distance from the bristles 2 towards the end 3*a*, remote from the bristles, of the handle 3 that the liquid medium issuing from the outlet orifice 14 is distributed better over the several rows of bristles than in the case where the outlet orifice is located close to the central topmost bristle or in the middle between the bristles. On the other hand, the distance must of course not be so large that the medium can run down past the bristles along the bristle carrier and drip off the latter. The precise distance depends in each case on the viscosity of the medium and on the adhesive forces between the medium and the plastic used for the manufacture of the bristle carrier, which forces result from the nature of the medium and that of the plastic.

If a medium is used which could undergo a change on prolonged storage under the action of light, in particular the ultraviolet fraction of daylight, it is advisable to metallise the outer surface of the handle or the inner wall of the reservoir, for example by depositing a metal coating from a high vacuum on the wall previously provided with a primer lacquer, for example by plating from the gas phase. A further protective coating can then be applied to the metal layer. If the metal used is chromium, mirror surfaces can be produced on the outer wall of the handle.

When the fountain brush is held with the bristles pointing upwards, it is possible, by looking through the cut-out 17 and through the bellows 11 or 31, provided the latter has been made from a sufficiently transparent material, to check whether medium is still present in the reservoir 4 or whether this has been consumed and the fountain brush can be thrown away.

The easy manner of filling the fountain brush according to the invention, and in particular the embodiments 7 to 11, makes it possible to use a filling machine of extremely simple construction. In the case of the previously known fountain brushes which must be filled through their end remote from the bristles, with the exception of that according to British Pat. Specification No. 244,915, it is always necessary, during filling, to provide a special machine part which closes the outlet orifice during the filling procedure. This is also necessary in the case of the fountain brush according to the last-mentioned British Patent Specification, though not for the purpose of closing the outlet orifice but in order to check, using this part as a sensor, whether the piston at the end of the connecting rod is, or is not, in the closing position. If this is not the case, a further special adjusting device must be present which brings the piston into the closing position by rotating the lid remote from the bristles.

What is claimed is:

1. A fountain brush having:

(a) a bristle carrier and, at one end of the latter, a set of bristles thereon;

(b) a handle attached to the other end of the bristle carrier and having a reservoir for a liquid or pasty medium in its interior, the end of said handle away from said bristles being open;

(c) a channel extending axially through the bristle carrier from the reservoir into the end of said carrier bearing the bristles and having at least one radial outlet orifice in the sidewall of said carrier, and ending blind in the bristlesbearing carrier end at a distance from said orifice;

(d) a slide valve member guided sealingly in the interior of said channel;

(e) an actuating device, attached to the end of the handle, remote from the bristles and comprising a closure member adapted for hermetically closing said reservoir having medium therein;

(f) a connecting rod, extending substantially axially through the interior of the reservoir, which connecting rod connects the actuating device and the slide valve member to one another and is of such length that when the actuating device is actuated, said connecting rod being rigidly resistant to pressure thereon in axial direction, said closing member being at such distance from said slide valve member that, in a filling position in which medium can be filled into said reservoir, said closing member leaves the open end of said handle free while said slide valve member seals off said reservoir in a position in said channel more remote from the blind end of the channel than said orifice;

(g) an elastically deformable bellows being connected hermetically sealingly with said closing member and the inner wall of said handle, in actuated as well as in unactuated position of said actuating device, thereby closing said reservoir, whereby said slide valve member obturates said orifice when in the said unactuated position and whereby, upon actuation by pressure on said closing-member, said slide valve member is moved into said blind end of said channel past said orifice clearing the latter; and (h) said bellows is integral with said closing member and has an outwardly crimped annular fold, the apex of which is turned toward the interior of the reservoir, the outer wall of said fold being sealingly fastened, along its periphery, to the inner wall of said handle.

2. A fountain brush as described in claim 1, wherein the inner wall of said handle has, in the region thereof between the open handle end and the apex of said annular fold, an annular groove into which the free periphery rim of said outer wall of said annular fold is inserted when medium is present in said reservoir.

3. A fountain brush as described in claim 2, wherein the wall of the handle enclosing the reservoir is rigid in a zone extending axially from its end nearest said bristles toward the end thereof remote from said bristles at least to the annular region where said bellows is joined to the inner wall of said handle.

4. A fountain brush as described in claim 3, wherein an open-ended rigid-walled sleeve is borne by the end of said handle remote from said bristles and surrounds said bellows.

5. A fountain brush as described in claim 4, wherein said sleeve has a lateral cut-out or opening through which said bellows can be depressed by a finger.

6. A fountain brush as described in claim 1, wherein the hermetic seal between said bellows and said closing member is an ultra-sound weld.

7. A fountain brush as described in claim 1, wherein the hermetic seal between said bellows and said closing member is a glued joint.

8. A fountain brush as described in claim 1, wherein the diameter of the connecting member is such that between its outer wall and the inner wall of the channel there only remains an annular gap of such diameter that it exerts a capillary action on the medium, slowing down its discharge.

9. A fountain brush as described in claim 1, wherein said bellows is integral with the wall of said handle surrounding said reservoir.

10. A fountain brush as described in claim 9, wherein said axial region is adjacent the joint between said connecting rod and said slide valve member.

11. A fountain brush as described in claim 10, wherein the remaining part of said connecting rod is stiffened by longitudinal ribs.

12. A fountain brush as described in claim 9, wherein said bellows comprises a single foldable angular zone near where it merges with said wall of said handle.

13. A fountain brush as described in claim 12, wherein the wall of said bellows between said foldable zone and its outer rim is stiffened.

14. A fountain brush as described in claim 9, wherein a turning handle element is provided on the outside of said closing member.

15. A fountain brush as described in claim 1, wherein said connecting rod is elastically bendable, at least in one axial region, by application of a transverse force.

16. A fountain brush as described in claim 15, wherein said closing member and the bellows connected to or integral therewith are adapted for displacement outwardly of said handle and laterally with bending of said bendable region of said connecting rod, whereby a gap remains between said bellows and the open end of said handle through which gap medium can be filled into said reservoir while said slide valve member seals said channel above said orifice in a position more remote from said bristles than from said orifice.

17. A fountain brush as described in claim 1, wherein said slide valve member is shaped as a piston having a cavity in its frontal end wall.

18. A fountain brush as described in claim 17, wherein said cavity extends rearward through said slide valve member into the portion of said connecting rod adjoining said slide valve member.

19. A fountain brush as described in claim 17, wherein said slide valve member bears an annular sealing bead about its circumference spaced from its frontal end wall.

20. A fountain brush as described in claim 1, wherein the end portion of the channel in the bristle carrier extends sufficiently far beyond the terminal actuating position of the slide valve member so that an air cushion is formed between the latter and the end wall of the channel when the slide valve member is pushed inwardly so as to free the outlet orifice.

21. A fountain brush as described in claim 1, wherein the interior of the bellows is a part of the reservoir in the handle, or is in free communication with the reservoir.

22. A fountain brush as described in claim 1, wherein a protective cap is provided for the bristles which cap can be mounted on the bristle carrier, transversely to the said longitudinal axis, and bears a nose part adapted for obturating said orifice.

* * * * *